United States Patent [19]

Sammons et al.

[11] Patent Number: 4,869,179

[45] Date of Patent: Sep. 26, 1989

[54] INTERCHANGEABLE PART PLASTIC PALLET

[76] Inventors: Larry P. Sammons, 114 Sleepy Hollow, Palestine, Tex. 75801; Larry D. Smith, 211 Limestone Trail, Killeen, Tex. 76543; William P. Carter, 305 Elbert St., Harker Heights, Tex. 76542

[21] Appl. No.: 270,805

[22] Filed: Nov. 14, 1988

[51] Int. Cl.[4] ..... B65D 19/12

[52] U.S. Cl. ..... 108/56.1; 108/51.1

[58] Field of Search ..... 108/51.1, 56.1

[56] References Cited

U.S. PATENT DOCUMENTS

| | | | |
|---|---|---|---|
| 2,783,960 | 3/1957 | Herz et al. | 108/56.1 |
| 3,059,887 | 10/1962 | Ward, Jr. | 108/51.1 |
| 3,651,769 | 3/1972 | Foley | 108/56.1 |
| 3,675,596 | 7/1972 | Cocas | 108/51.1 |
| 3,902,692 | 9/1975 | Skinner | 108/56.1 X |
| 4,112,854 | 9/1978 | Pitchford | 108/56.1 |

FOREIGN PATENT DOCUMENTS

| | | | |
|---|---|---|---|
| 2111135 | 9/1972 | Fed. Rep. of Germany | 108/56.1 |

*Primary Examiner*—Peter A. Aschenbrenner
*Attorney, Agent, or Firm*—Joseph F. Long

[57] ABSTRACT

A replaceable part pallet designed to be assembled from two moldable shapes, one being a beam and the other being a slat with projections to extend through holes contained in the beams so that a single rod may be installed longitudinally through each beam and through projections on the slats to hold slats firmly fastened to three or more beams to form the pallet.

7 Claims, 2 Drawing Sheets

INTERCHANGEABLE PART PLASTIC PALLET

BACKGROUND OF THE INVENTION

In many phases of manufacturing, agriculture, service, communication, transportation, industries (as well as others) forklift trucks are commonly used and most commonly the object or objects to be moved are placed upon a pallet specifically designed to allow the tines of the forklift truck to slide into either side of the pallet. The forklift truck operator then raises the tines and moves the forklift as necessary to place the objects in the desired position.

Pallets are usually constructed of rough hardwood with slats nailed to larger wooden braces. Even when the forklift driver exercises care in operation, the momentum of the forklift and limited control results in breakage of one or more slats of a pallet rather easily. This results in limited life of a wooden pallet.

Wood for pallets is becoming scarcer and more expensive while engineering type plastics are becoming increasingly more available with enhanced engineering properties. For example, Kevlar® is five times as strong as steel on a weight basis and Nylon® and other plastics are increasingly replacing metal for gears.

The present invention is aimed at filling the need for a lower in-use cost pallet of a material primarily other than wood.

Recognizing that the normal pallet handling will result, in time, with pallet damage, the present invention covers a unique manner of fabrication of a pallet from two moldable shapes with these shapes being held rigidly connected with metal rods. The assembly is easily disassembled with hand tools so that a damaged part of the pallet may be readily replaced. Briefly the pallet which is usually about 40" by 48" is formed with six or more slats on the top side and three or more slats on the bottom side of three identical beams. The beams have depressions so that the slats fit flush with the beam surfaces. At the center of each depression is a hole with a minimum of a one square inch cross section with the hole extending through the beam. Each slat has three or more projections that fit into these holes. With slats with three projections, three beams are used and the projection location positions the beams. The projections will go more than half way through the beam. The projections are sufficiently long so that a projection on a slat used on the bottom of the pallet goes a minimum of one inch past a projection on a slat used on the top of the pallet. This is necessary to allow drilling or fabricating the beams and projections so that a rod a minimum of $\frac{1}{8}$" in diameter may be run longitudinally through the beams and projections of the slats so that one rod through each beam securely fastens both top and bottom slats to the beams.

The design of the pallet structure as outlined allows the use of all plastic material or the substitution of either two or more slats or one or more beams of metal construction to give added strength for some special purpose pallets. In one embodiment a metallic box-like structure is fitted over the ends of the plastic beams and the first slat on top of the pallet on each end of the beams or each side of the pallet. These box-like structures are held securely fastened with nuts on threaded ends of the rods that run longitudinally through the beams to fasten the slats to the beams. Openings in the metal box-like structure may be sized to allow easy access of the forklift tines. In other embodiments the metal box-like structure is not used but the first top slat on each side is made of metal instead of plastic.

The plastic chosen will depend upon specific use of the pallet and price and properties of the plastic; for many uses Nylon®, Kevlar®, Delrin®, high density polypropylene, high density polyethylene, fiber glass re-enforced polyester, or polycarbonates should be suitable.

The following patents have been considered:

| Ser. No. | Filing Date |
|---|---|
| 3,878,796 | 12/5/1973 |
| 4,145,976 | 3/27/1978 |
| 4,359,948 | 4/7/1980 |
| 3,857,342 | 6/7/1973 |
| 4,051,786 | 6/23/1975 |
| 3,880,092 | 4/29/1975 |
| 4,597,338 | 11/14/1984 |
| 3,835,792 | 10/30/1972 |

The present invention covers a unique design to construct a pallet from only two moldable shapes with the shapes being held together with one rod slideably installed through one molded beam shape and through projections on one molded slat shape fitting closely into openings for these projections in the molded beam shapes. This unique construction allows for substitution of metal parts where special use indicates the desirability.

BRIEF DESCRIPTION OF THE INVENTION

This invention covers design of a pallet specifically suited to be manufactured from a plastic material with substitution of metal parts where needed for particular application. Nylon®, Delrin®, Kevlar®, or similar plastics should be suitable for this use.

In one preferred embodiment three identical beams are used with the beams being less than 48" long, less than 8" deep and more than $1\frac{1}{2}$" wide; each beam has six nearly semi-circular depressions on the top narrow face of the beam with one depression on either end of the beam and with four other equally spaced similar depressions. These depressions may be more than $\frac{3}{4}$" deep and more than 3" wide. Centrally located in each depression is a hole of a minimum of one square inch cross section extending down through the beam.

Three exactly similar depressions with holes extending upward more than $\frac{3}{4}$ of the way through the beam are used on the lower narrow face of the beams. The depressions on either end of the lower narrow face of beam would be located at least one slat width back from the end of the beam with one depression centrally located in the beam.

In a pallet of the size described each beam would have two rectangular depressions in the lower narrow face; these depressions may be approximately 2" by 10" to allow easy access of the tines of the forklift.

Slats are molded to fit the depressions described in the beams with projections on the slat to fit the holes in the beams and extend approximately $\frac{3}{4}$ the way through the beams. These are used on the top and bottom of the beams to form the pallet. In a pallet approximately 48" long the usual width is approximately 40" and slats would then be approximately 40" long with projections located so that the edge of the two outer beams would be flush with the end of the slats when the slats projections are fitted into the beams. With the approximate 48"×40" pallet six slats may be used on top of three beams and three slats may be used on the lower side of the beams. Assembly is completed by installing a metallic rod, that may be threaded on each end and a minimum of ⅛" in diameter, longitudinally through a hole centrally located in the beam and through holes in the projections on both the upper and lower slats so that three rods will connect the six slats above and three below the three beams to form a pallet. Nuts with washers are tightened on either end of the rods complete the pallet assembly. We have described in detail only one size pallet but similar designs using a metallic rod to connect protrusions that form an integral part of slats to form various sized pallets with molded beams may be used for specific applications and could be similarly described.

In a second embodiment of this invention depressions in the beams are rectangular and slats are molded to fit these rectangular depressions. This second embodiment is otherwise the same as the first embodiment.

In a third embodiment a metallic box-like re-enforcing structure is fitted over the ends of the beams after the slats are connected to the beams. The metallic box-like structure contains holes sized and located so that the rods may go through the metallic box-like structure and the nuts on the metallic rods used in the assembly may be tightened to hold the metallic re-enforcing structure firmly in place. This metallic re-enforcing structure further contains openings to allow easy access of the tines of the forklift.

In either embodiment two or more of the slats that usually are of plastic may be replaced with the same shape metal slat for increased pallet strength and rigidity.

Obviously minor design changes could be made and we wish to be limited only to the general spirit, purpose and approach as outlined in these claims and specifications.

DETAILED DESCRIPTION OF THE DRAWINGS

Figure 1:
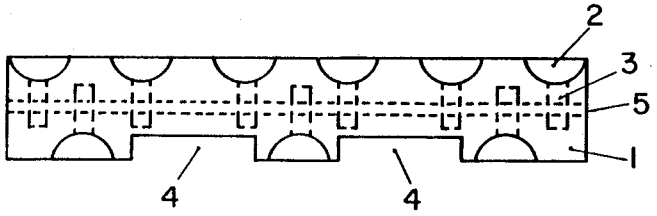
FIG. 1 is a side view indicating depressions in one beam and arrangement of slats with semi-circular cross sections so that one metallic rod connects the slats both upper and lower with the beam.

In FIG. 1 we show a side view of beams 1, with semi-circular depressions 2 having holes 3 in each depression 2 going completely through the beam 1 and with rectangular depressions 4 on the lower side of beam 1 to allow access for forklift tines. The beam 1 contains a hole 5 a minimum of ⅛" in diameter longitudinally through the beam.

Figure 2:
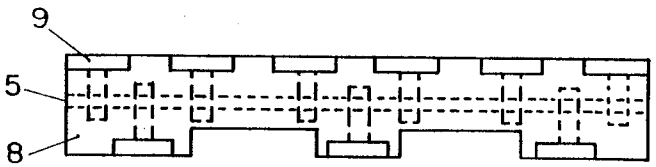
FIG. 2 is similar to FIG. 1 but indicates a slat of rectangular cross section.
Figure 4:
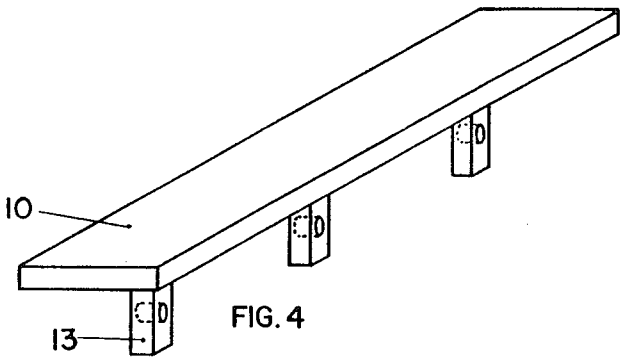
FIG. 4 shows a slat with a rectangular cross section and rectangular projections used to fasten the slat in the beams.
Figure 5:
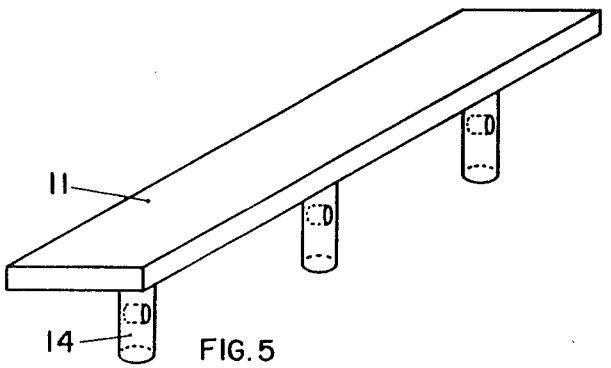
FIG. 5 shows a slat with a rectangular cross section with cylindrical projections.

FIG. 2 shows a side view of a second embodiment of the invention wherein beam 8 has rectangular depressions to fit slats 9 and 10, FIG. 4 and FIG. 5. The beams 8 are otherwise the same as beams 1.

Figure 3:
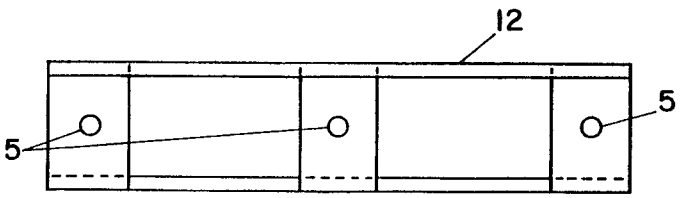
FIG. 3 is an end view showing the three beams and end view of the rods used to connect the slats with the beams.

FIG. 3 shows an end view of beams 1 (or beams 8) in an assembly using three beams. In one preferred embodiment slats 12 are semi-circular with cylindrical projections shown in detail in FIG. 6.

In FIG. 4 we show slat 10 with rectangular cross section and three rectangular projections 13 each containing holes a minimum of ⅛" in diameter with the holes being properly located to exactly align with the longitudinal hole in beam 8 when slat 10 is used with beam 8 and when beam 8 has a square hole through beam 8 centrally located in depression 9 of beam 8.

In FIG. 5 we show slat 11 with a rectangular cross section and three cylindrical projections each containing a hole, said holes being properly located to exactly align with a longitudinal hole contained in beam 8 when beam 8 has circular holes centrally located in depressions 9.

Figure 6:
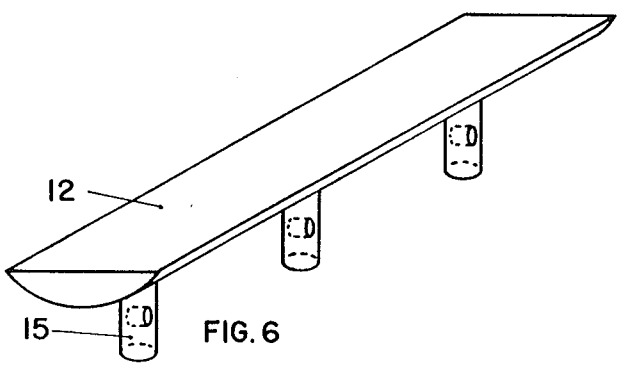
FIG. 6 shows a slat with an essentially semi-circular cross section to increase slat rigidity and cylindrical projections.

FIG. 6 shows a slat 12 with semi-circular cross section to fit into depressions 2, FIG. 1 in beams 1. Slat 12 has three cylindrical projections 15 sized to fit into holes centrally located in depressions 2, FIG. 1 and each cylindrical projection has a hole located to exactly align with longitudinal hole 5 in beam 1, FIG. 1.

Figure 7:
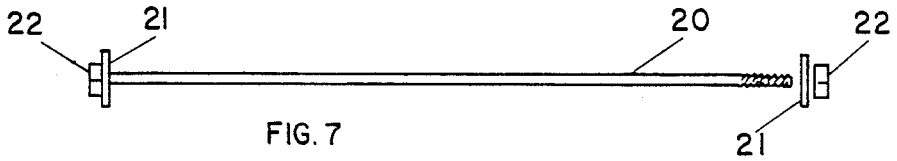
FIG. 7 shows a rod used to fasten the slats to the beams to complete the pallet assembly.

FIG. 7 shows a rod 20, a minimum of ⅛" in diameter and threaded on each end with washers 21 and nuts 22 that is used to anchor projections in the slats firmly in the beams in any of the above embodiments.

Figure 8:
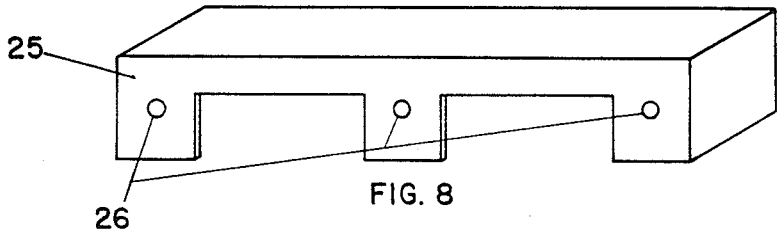
FIG. 8 shows a metallic box-like re-enforcing structure that may be used over the ends of the beams to increase pallet rigidity.

FIG. 8 shows a box-like metallic structure 25 that may be slipped over each end of the beams 1, FIG. 1 or beams 8, FIG. 2 with holes 2 so located that rods 20, FIG. 7 may fasten this reenforcing structure over the assembled pallet.

Figure 9:
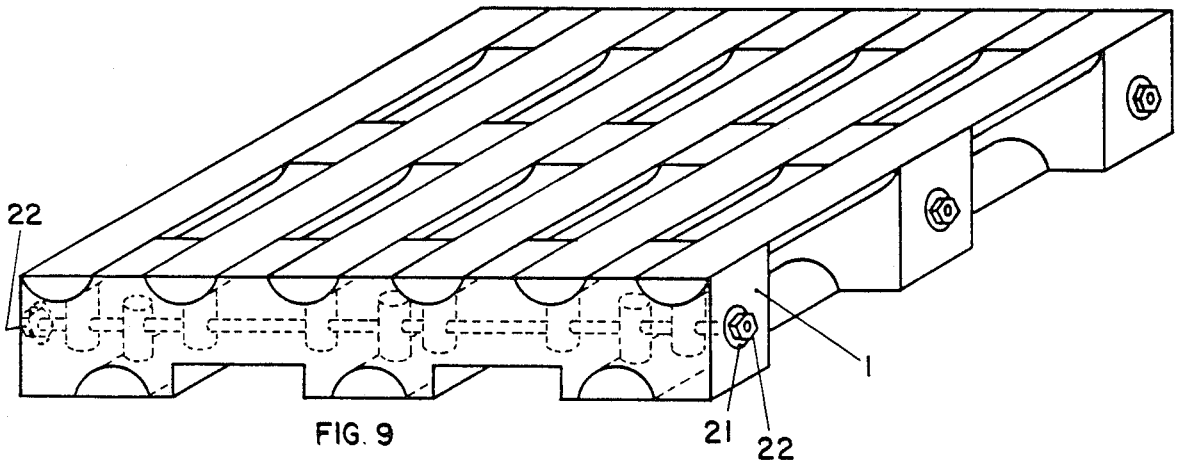
FIG. 9 shows an assembled view of the pallet.

FIG. 9 shows one preferred embodiment of the assembled pallet with beams 1. FIG. 1, slats 12, FIG. 6 and washers 21 and nuts 22 for the assembly rods.

What is claimed is:

1. A replaceable part plastic pallet comprising:

a. a minimum of three identical beams, each containing a hole a minimum of ⅛" in diameter centrally located through the length of said beam; and each containing a minimum of six depressions in a top surface narrow face with a hole a minimum of one square inch cross section centrally located in said six depressions and extending more than halfway through the wider faces of said three identical beams; each of said three identical beams further containing a minimum of three depressions with a hole of a minimum of one square inch in cross section centrally located in each of said three depressions in the lower surface narrow face; said six depressions containing holes in said top surface narrow face and said three depressions in said lower surface narrow face being the same size and containing the same size holes and each of said three identical beams having two depressions in said lower narrow face suitably spaced for tines of a fork lift to slide into said depressions;

b. a minimum of nine identical slats with each of said identical slats having three projections and with said slats and said projections being sized to fit into said six depressions and said three depressions containing holes in said three identical beams; each of said three projections on said slats having a hole a minimum of ⅛" in diameter at right angles to the longer axis of said identical slats:

C. three rods having threaded ends and being a minimum of ⅛" in diameter and a minimum of ½" longer than said three identical beams fasten said identical slats to said three identical beams as follows: six slats of said nine identical slats are placed at right angles to said three identical beams and a first one of said three projections on each of said six slats is fitted into a hole contained in each of said six depressions in said top surface narrow face of a first one of said three identical beams; a second one of said three projections on each of said six slats is fitted into a hole contained in each of said six depressions in said top surface narrow face of a second one of said three identical beams; and a third one of said three projections on each of said six slats is fitted into a hole contained in each of said six depressions in said top surface narrow face of a third one of said three identical beams; three slats of said nine identical slats are placed below and at right angles to said three identical beams and a first one of said three projections on each of said three slats is fitted into a hole contained in each of said three depressions in said lower surface narrow face of a first one of said three identical beams; and a second one of said three projections on each of said three slats is fitted into a hole contained in each of said three depressions in said lower surface narrow face of a second of said three identical beams and a third one of said three projections on each of said three slats is fitted into a hole contained in each of said three depressions in said lower surface narrow face of a third one of said three identical beams; after joining said three identical beams and said nine identical slats as described a rod having threaded ends and being a minimum of ⅛" in diameter and minimum of ½" longer than one of said three identical beams, is installed thru a hole contained in each of said three identical beams and thru a hole contained in each of said three projections on said nine identical slats thereby rigidly attaching said nine identical slats to said three identical beams by tightening nuts on each end of said threaded ends of said three rods.

2. A replaceable part plastic pallet as in claim 1 where said slats have a cross section with a flat upper face and an elliptical lower face with said three projections being cylindrical in shape.

3. A replaceable part plastic pallet as in claim 1 where said slats have a rectangular cross section and said projections have a square cross section.

4. A replaceable part plastic pallet as in claim 1 where said slats have a rectangular cross section and said projections are cylindrical in shape.

5. A replaceable part plastic pallet as in claim 1 where a metallic box-like reinforcing structure containing openings suitable to admit tines of a forklift and holes to admit said rods used to fasten said nine slats to said three identical beams is placed over each end of said three identical beams and fastened in place by nuts on threaded ends of said rods.

6. A replaceable part plastic pallet as in claim 1 where a minimum of two of said slats with said three projections are formed of metal.

7. A replaceable part plastic pallet comprising three identical beams each with an oblong cross section and containing a multiplicity of holes thru the longer axes of said oblong cross section and each containing a hole a minimum of ⅛" in diameter running thru the length of each of said three identical beams, three metal rods threaded on each end, and a multiplicity of identical slats, each of said multiplicity of slats having three projections sized to fit into holes contained in said beams with each of said three projections containing a hole a minimum of ⅛" in diameter located so assembly may be completed by installing a first portion of said multiplicity of identical slats on a top face of said three identical beams by pushing one of said three projections into a hole contained in each of said three identical beams and installing a second portion of said multiplicity of identical slats in a bottom face of said three identical beams in the same manner and fastening both said first portion and said second portion of said multiplicity of identical slats to said three identical beams by inserting one of said three threaded rods thru a hole contained in each of said three identical beams and a hole contained in each of said three projections on said multiplicity of identical slats and tightening nuts on each end of said three metal rods.

* * * * *